US010073404B2

(12) United States Patent
Kokubo

(10) Patent No.: US 10,073,404 B2
(45) Date of Patent: Sep. 11, 2018

(54) CURL CORRECTION DEVICE AND IMAGE FORMING APPARATUS

(71) Applicant: CANON KABUSHIKI KAISHA, Tokyo (JP)

(72) Inventor: Hiroshi Kokubo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/208,272

(22) Filed: Jul. 12, 2016

(65) Prior Publication Data

US 2017/0017189 A1 Jan. 19, 2017

(30) Foreign Application Priority Data

Jul. 14, 2015 (JP) ..... 2015-140582

(51) Int. Cl.
*G03G 15/00* (2006.01)
*G03G 15/23* (2006.01)

(52) U.S. Cl.
CPC ..... *G03G 15/6576* (2013.01); *G03G 15/235* (2013.01); *G03G 2215/00586* (2013.01); *G03G 2215/00662* (2013.01); *G03G 2215/00704* (2013.01); *G03G 2215/0129* (2013.01)

(58) Field of Classification Search
CPC ..... G03G 15/6576
USPC ..... 399/406
See application file for complete search history.

(56) References Cited

U.S. PATENT DOCUMENTS 4,326,915 A * 4/1982 Mutschler, Jr. ..... B65H 23/34 162/271
5,017,970 A * 5/1991 Sakata ..... G03G 15/2028 162/271
5,920,759 A * 7/1999 Ushiroji ..... B65H 29/12 162/271
8,045,915 B2 * 10/2011 Faber ..... G03G 15/6576 399/406
8,413,982 B2 * 4/2013 Honda ..... B65H 5/062 271/188
8,960,673 B2 * 2/2015 Yoshida ..... B65H 29/125 271/225
2010/0143014 A1 * 6/2010 Kim ..... G03G 15/235 399/406
2011/0142517 A1 * 6/2011 Kanai ..... G03G 15/6576 399/406
2011/0142518 A1 * 6/2011 Nishida ..... G03G 15/6576 399/406
2011/0318031 A1 * 12/2011 Chiyoda ..... G03G 15/657 399/45

(Continued)

FOREIGN PATENT DOCUMENTS

JP 2010173831 A 8/2010

*Primary Examiner* — Anthony Nguyen
(74) *Attorney, Agent, or Firm* — Canon U.S.A., Inc. IP Division

(57) ABSTRACT

The curl correction device includes a first guide that guides a sheet to a nip portion between a first rotation member and a second rotation member, a support portion that rotatably supports the first guide about a fulcrum on the downstream side of the first guide, and a restriction portion that restricts a rotation of the first guide rotating about the fulcrum by being in contact with the first guide. The first guide is rotatable about the fulcrum so as to become separated from the restriction portion.

20 Claims, 10 Drawing Sheets

(56) References Cited

U.S. PATENT DOCUMENTS

| | | | | |
|---|---|---|---|---|
| 2013/0142525 | A1* | 6/2013 | Nonaka | G03G 15/6576 399/16 |
| 2014/0140746 | A1* | 5/2014 | Egawa | G03G 15/6576 399/406 |

* cited by examiner

CURL CORRECTION DEVICE AND IMAGE FORMING APPARATUS

BACKGROUND OF THE INVENTION

Field of the Invention

The present disclosure relates to a curl correction device that corrects a curl in a sheet and an image forming apparatus provided with the same.

Description of the Related Art

An image forming apparatus is provided with a curl correction device that corrects a curl in a sheet on which an image has been formed (Japanese Patent Laid-Open No. 2010-173831). The curl correction device of Japanese Patent Laid-Open No. 2010-173831 is provided with a curl correction unit that corrects a curl in a sheet by forming a nip by pressing a roller against a belt that is stretched across two rollers.

A guide that guides a sheet to the curl correction unit is disposed upstream of the curl correction unit. In order to enable the guide to guide a thin sheet to the nip of the curl correction unit in a stable manner, the guide is disposed close to the nip of the curl correction unit. The above is because, if, supposedly, the guide is disposed distanced away from the nip of the curl correction unit, the front end of the sheet cannot be sent into the nip of the curl correction unit in a smooth manner and a corner bend may be disadvantageously created in the front end of the thin sheet.

However, when the guide disposed on the upstream side of the curl correction unit is disposed close to the nip of the curl correction unit, a shortcoming may occur when conveying a thick sheet. In other words, because the thick sheet is abutted hard against the guide when the thick sheet is passed through the nip of the curl correction unit, the sheet may become damaged, disadvantageously. The above is because, the thick sheet that is bent at the curved nip of the curl correction unit is abutted hard against the guide at a portion upstream of the nip of the curl correction unit.

SUMMARY OF THE INVENTION

The present disclosure prevents a corner bend from being created in a thin sheet and prevents damage to be caused in a thick sheet. A curl correction device of the present disclosure includes a correction unit including a first rotation member and a second rotation member that is in pressure contact with the first rotation member and deformed by the first rotation member, a curved nip portion being formed with the first rotation member and the second rotation member, the correction unit correcting a curl in a sheet while pinching and conveying the sheet with the nip portion, a guide portion including a first guide disposed on a side in which a surface of the sheet comes in contact with the first rotation member, and a second guide disposed on a side in which a surface of the sheet comes in contact with the second rotation member, the guide portion guiding the conveyed sheet to the nip portion, a support portion that rotatably supports the first guide about a fulcrum of the first guide on a downstream side of the first guide in a conveyance direction, and a restriction portion that restricts, by being in contact with the first guide, a rotation of the first guide about the fulcrum in a direction in which the first guide becomes closer to the second guide. In the curl correction device, the first guide is rotatable about the fulcrum so as to become separated from the restriction portion.

Further features of the present invention will become apparent from the following description of exemplary embodiments with reference to the attached drawings.

DESCRIPTION OF THE EMBODIMENTS

Hereinafter, exemplary embodiments of the present disclosure will be described. While the exemplary embodiments described below are examples of the best modes according to the present disclosure, the present disclosure is not limited to the exemplary embodiments.

First Exemplary Embodiment

Figure 1:
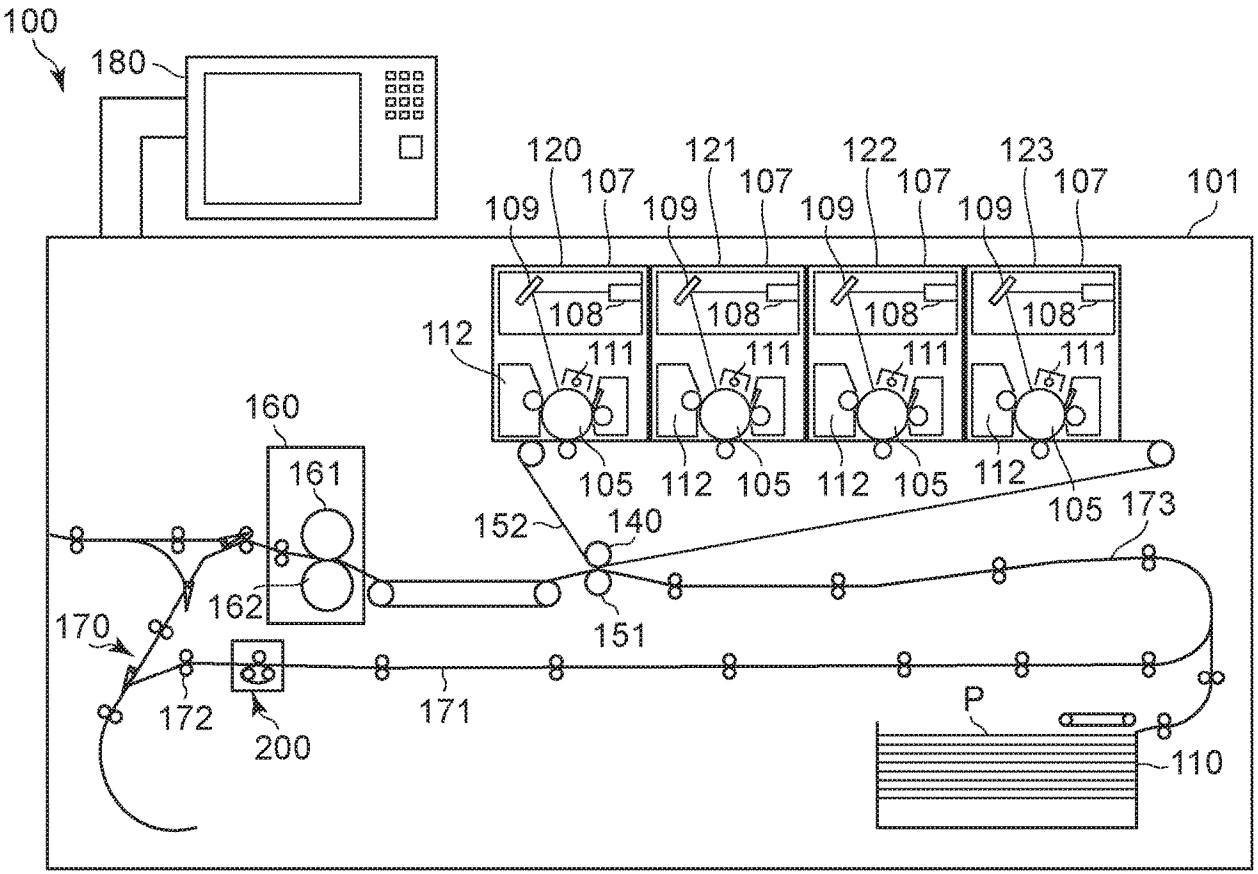
FIG. 1 is a general view of an image forming apparatus.

FIG. 1 is a cross-sectional view illustrating a structure of a laser beam printer 100 (hereinafter, referred to as a printer) of an exemplary embodiment according to the present disclosure. The printer 100 includes a housing 101. The housing 101 includes various mechanisms constituting an image forming unit. An operation unit 180 for the user to operate the printer 100 is provided at the upper portion of the housing 101.

The various mechanisms of the image forming unit include laser scanner units 107, primary chargers 111, photosensitive drums 105, developing units 112, an intermediate transfer unit 152, and a transfer roller 151.

Each laser scanner unit 107 emits a laser beam according to image data. The laser beams from the laser scanner units 107 is guided to the photosensitive drums 105 through reflecting polygon mirrors 109 and expose the photosensitive drums 105, which have been charged by the primary chargers 111, in the main scanning direction.

The electrostatic latent images formed on the photosensitive drums 105 with the laser beams are visualized as toner images with toner supplied from the developing units 112. The toner images on the photosensitive drums 105 are transferred (primary transferred) onto the intermediate transfer unit 152 to which a voltage that is inverse with respect to the voltage of the toner images is applied. A Y (yellow) station 120, an M (magenta) station 121, a C (cyan) station 122, and a K (black) station 123 each form a toner image of the corresponding color onto the intermediate transfer unit 152 in a sequential manner. As a result, a full color visible image is formed on the intermediate transfer unit 152.

Meanwhile, a sheet P fed from a container 110 of the sheet P is conveyed to the feed path 173. The visible image formed on the intermediate transfer unit 152 is transferred onto the conveyed sheet P with the transfer roller 151. Note that the transfer of the toner images onto the sheet P described above is referred to as a secondary transfer.

By having the sheet P to which the toner images have been transferred pass through a fixing unit 160, the toner images are fixed to the sheet P. The fixing unit 160 includes a fixing rotary member 161 and a pressing rotation member 162. The fixing unit 160 fixes the toner images to the sheet P by heat-fusing the toner transferred on the sheet P by the pinching and conveying the sheet P with the fixing rotary member 161 and the pressing rotation member 162.

In a case of duplex printing in which images are formed on both surfaces of the sheet P, the sheet P is sent to a reversing unit 170. Subsequently, the sheet P is switched back and reversed with the reversing unit 170. The sheet P on which switchback reversal has been performed is conveyed through a duplex conveyance path 171 with a conveyance roller 172. The sheet P is guided into the transfer unit 152 once again through the duplex conveyance path 171 and the toner images are transferred onto the back surface of the sheet P. Subsequently, by having the sheet P pass through the fixing unit 160 once again, the toner images on the sheet P are heated and fixed, and the sheet P is discharged outside the printer 100.

The printer 100 can deal with various types of paper, from those referred to as plain paper and recycled paper that are widely used to those referred to as glossy paper and coated paper, and from thin sheets to thick sheets.

A curl, the amount of which is in accordance with the sheet thickness, surface nature, and the amount of toner that has been transferred, is created in the sheet P that has passed through the fixing unit 160. Accordingly, the sheet P is passed through a decurler 200 to correct the curl in the sheet P that has been fixed. The decurler 200 serving as a curl correction device that corrects the curl in the sheet P is provided in the duplex conveyance path 171 that is the conveyance path through which the sheet P after switchback reversal is conveyed.

Figure 2:
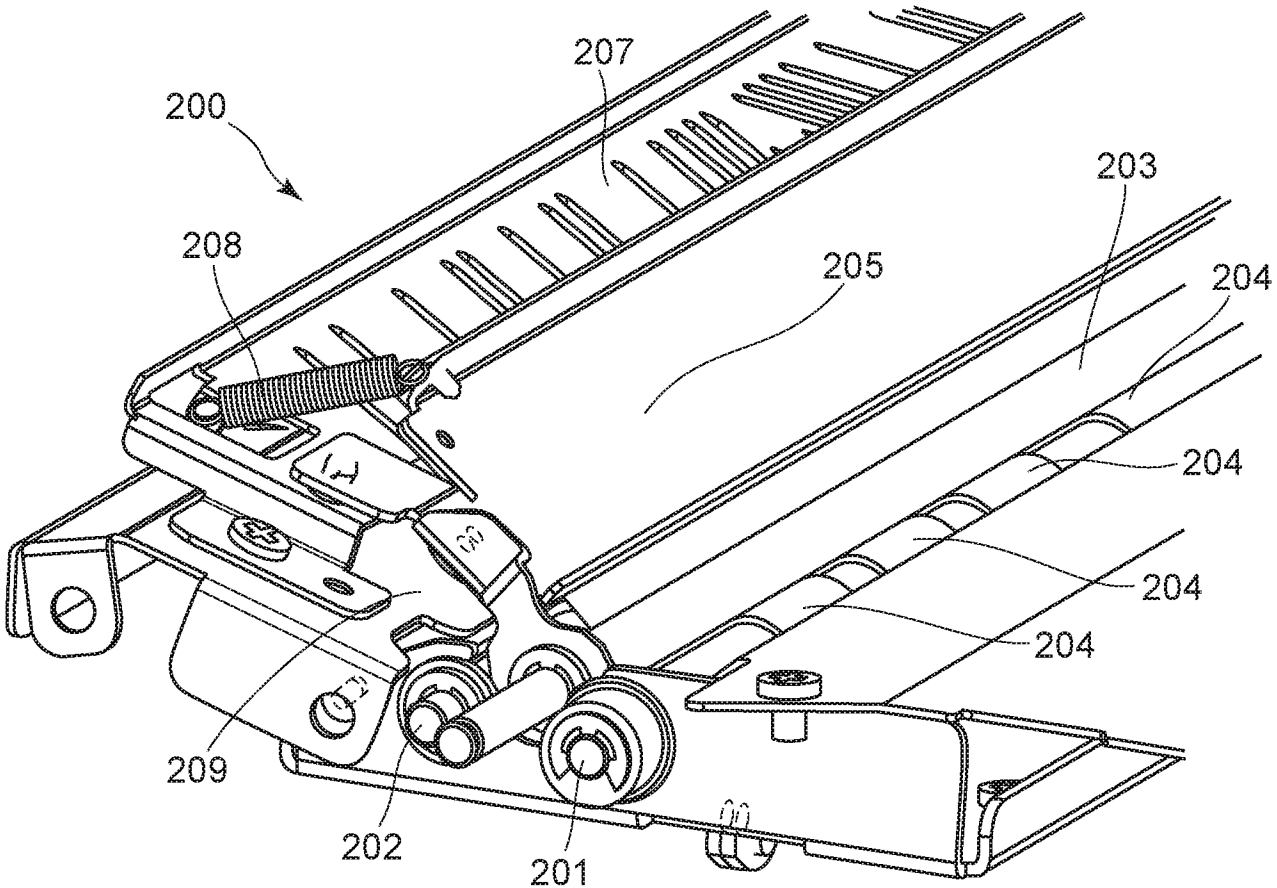
FIG. 2 is a perspective view of a decurler of a first exemplary embodiment.

Hereinafter, a configuration of the decurler 200 will be described. FIG. 2 is a perspective view of the decurler 200. Furthermore, FIG. 3 is a side view of the decurler 200.

The decurler 200 includes a roller 203 serving as a first rotation member, and belts 204 serving as a second rotation member against which the roller 203 is pressed. The belts 204 are disposed in an axial direction in a plural number. The belts 204 are stretched across by two rollers fixed to the side plates of the decurler 200, in other words, the belts 204 are stretched across by a belt driving roller 201 and a belt driven roller 202. The belt driving roller 201 rotated by a drive transmitted from a motor (not shown). Upon rotation of the belt driving roller 201, the belts 204 are rotated. The roller 203 follows the rotating belts 204. A correction unit that corrects a curl of a sheet is constituted by the roller 203 and the belts 204.

Figure 3:
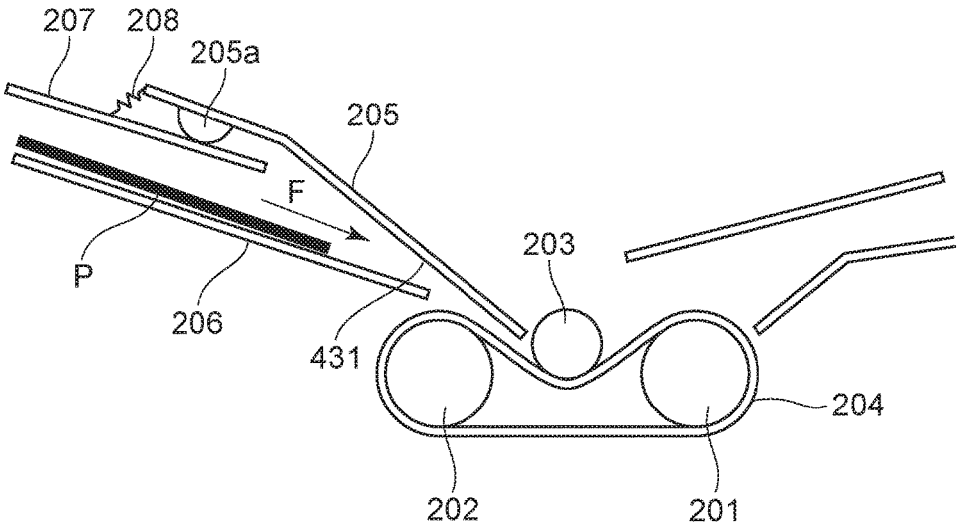
FIG. 3 is a side view of the decurler of the first exemplary embodiment.

As illustrated in FIG. 3, nip portions formed by the roller 203 and the belts 204 are curved nip portions having a shape that conforms to the outer circumferential surface of the roller 203. By rotating the belts 204 while the sheet P is pinched by the nip portions between the roller 203 and the belts 204, the decurler 200 corrects the curl of the sheet P while the sheet P is conveyed in a conveyance direction.

Figure 4:
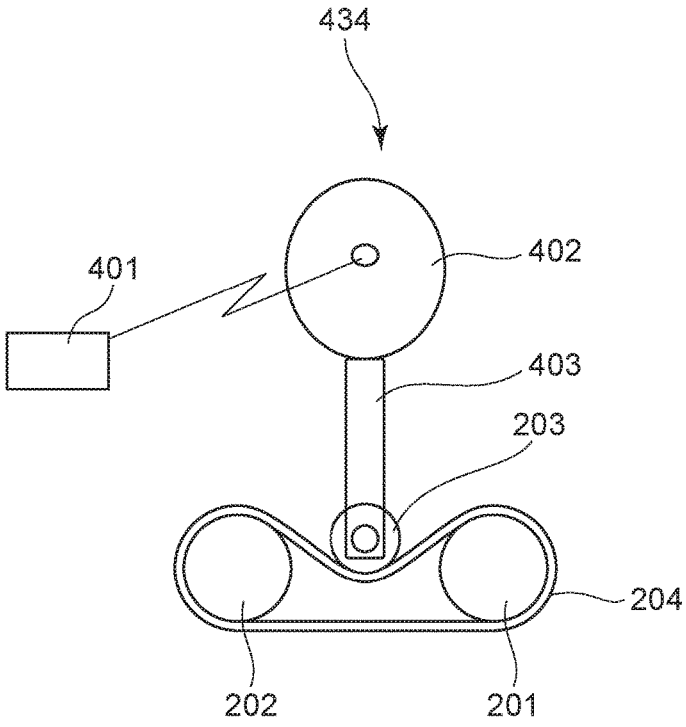
FIG. 4 is an explanatory drawing for describing a configuration of an inroad amount adjustment unit of the decurler.

FIG. 4 is a cross-sectional view illustrating a configuration of an inroad amount adjustment unit 434 that adjusts an inroad amount of the roller 203 with respect to the belt 204. The inroad amount adjustment unit 434 serving as a moving unit that moves the roller 203 in the sheet thickness direction moves the roller 203 up and down.

In other words, the roller 203 is biased in a direction that bends the belts 204 with a cam 402 through a holding member 403. Together with the holding member 403 that holds the roller 203, the roller 203 is held in a movable manner with respect to the belts 204. An end portion of the holding member 403 is in contact with the cam 402 that is rotationally driven by a cam motor 401. The inroad amount (a pressing amount) of the roller 203 into the belts 204 can be changed by changing the position of the cam 402 in the rotational direction of the cam 402 by driving the cam motor 401. In other words, by rotating the cam 402, the inroad amount of the roller 203 with respect to the belts 204 is adjusted.

As the roller 203 moves down and as the inroad amount into the belts 204 becomes larger, the widths of the nip portions between the roller 203 and the belts 204 increase and the curl correction ability increases.

Figure 12:
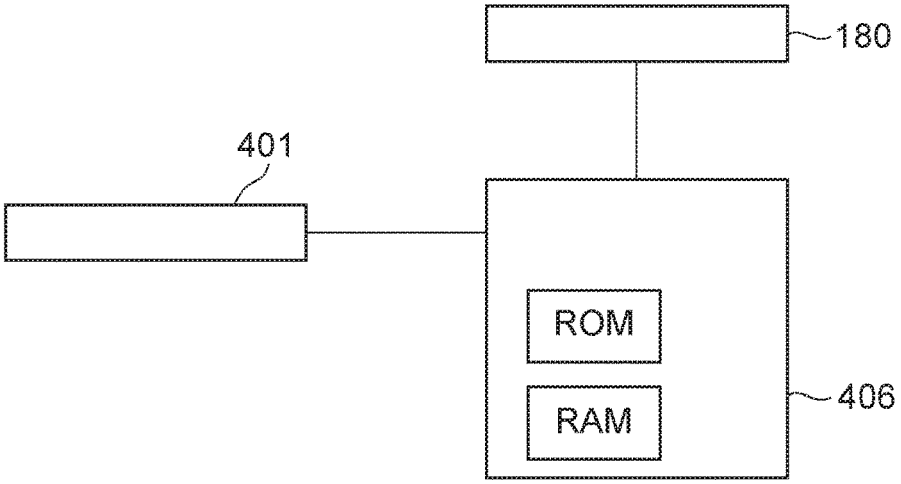
FIG. 12 is block diagram of the decurler.
Figure 13:
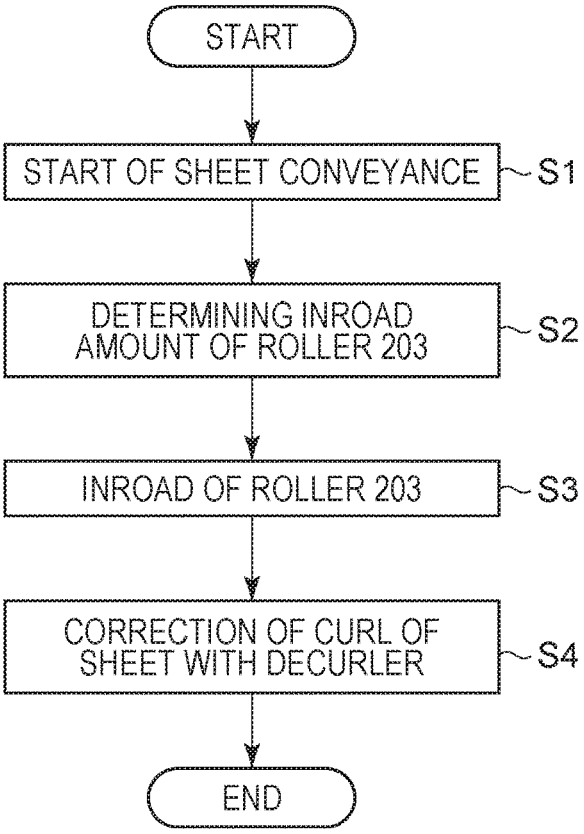
FIG. 13 is a flowchart related to the operation of the decurler.

FIG. 12 is a control block diagram related to the decurler 200. FIG. 13 is a flowchart of an operation related to curl correction.

By controlling the rotation of the cam motor 401, a control unit 406 illustrated in FIG. 12 changes the correction ability of the decurler 200. The operation unit 180 which the user operates is connected to the control unit 406.

The curling amount of the sheet arriving at the decurler 200 is different depending on the applied amount of toner that is transferred and fixed to the sheet and on the sheet type. Accordingly, the inroad amount of the roller 203 is determined according to a table that is obtained through results of an experiment that has been conducted in advance and that is associated with the applied amount of toner and the sheet type. In other words, the control unit 406 controls the cam motor 401 such that the roller 203 makes an inroad into the belts 204 by the amount corresponding to the curling amount that is estimated, through the experiment conducted in advance, to be formed in the sheet arriving at the decurler 200. With the above operation, the curling amount of the sheet after passing through the decurler 200 becomes smaller than the curling amount of the sheet before passing through the decurler 200.

Subsequently, an operation of the decurler 200 will be described with reference to the flowchart in FIG. 13. The operation described with FIG. 13 is performed with the control unit 406 controlling various portions of the printer 100 through a program stored in a ROM and through a RAM as the work area.

After the user inputs information related to the sheet type, such as the basis weight and size of the sheet, into the operation unit 180, the control unit 406 starts conveyance of the sheet (S1). At this point, the control unit 406 determines the inroad amount of the roller 203 on the basis of the sheet type and the applied amount of toner of the image formed on the sheet while referring to the table set in advance (S2). Next, the control unit 406 controls the cam motor 401 so that the determined inroad amount is obtained (S3). Subsequently, when the sheet arrives at the decurler 200, the curl of the sheet is corrected by the decurler 200 (S4).

Incidentally, as illustrated in FIG. 3, the sheet is guided by an upstream guide 207 and a lower guide 206 towards the nip portions between the roller 203 and the belts 204. Subsequently, the sheet is guided to the nip portions by an upper guide 205 and the lower guide 206. A guide portion that guides the sheet to the nip portions between the roller 203 and the belts 204 is constituted by the upper guide 205 and the lower guide 206.

The upper guide 205 serving as a first guide includes, at an underside thereof, a guide surface 431 that comes in contact with the conveyed sheet and that guides the sheet. The guide surface 431 guides a surface of the sheet that is on the side that comes in contact with the roller 203. The lower guide 206 serving as a second guide guides a surface of the sheet that is on the side that comes in contact with the belts 204.

A detailed configuration of the upper guide 205 will be described next with reference to FIGS. 3 and 5.

As illustrated in FIG. 3, the upper guide 205 is disposed such that an end portion (an end portion on the downstream side in the sheet conveyance direction) of the guide surface 431 of the upper guide 205 is close to the roller 203 and the belts 204. Furthermore, the lower guide 206 is disposed such that an end portion of the lower guide 206 is close to the roller 203 and the belts 204. Furthermore, the guide 205 is disposed close to the lower guide 206 in the thickness direction of the sheet. In other words, the gap between the upper guide 205 and the lower guide 206 is small.

In the present exemplary embodiment, the distance between the end portion of the guide surface 431 of the upper guide 205 and the roller 203 is set to 0.5 mm to 1.5 mm. The gap between the upper guide 205 and the lower guide 206 is set to 1.0 mm to 2.0 mm. The distance between the upper guide 205 and the belts 204 is set to 0.3 mm to 1.0 mm.

Figure 5:
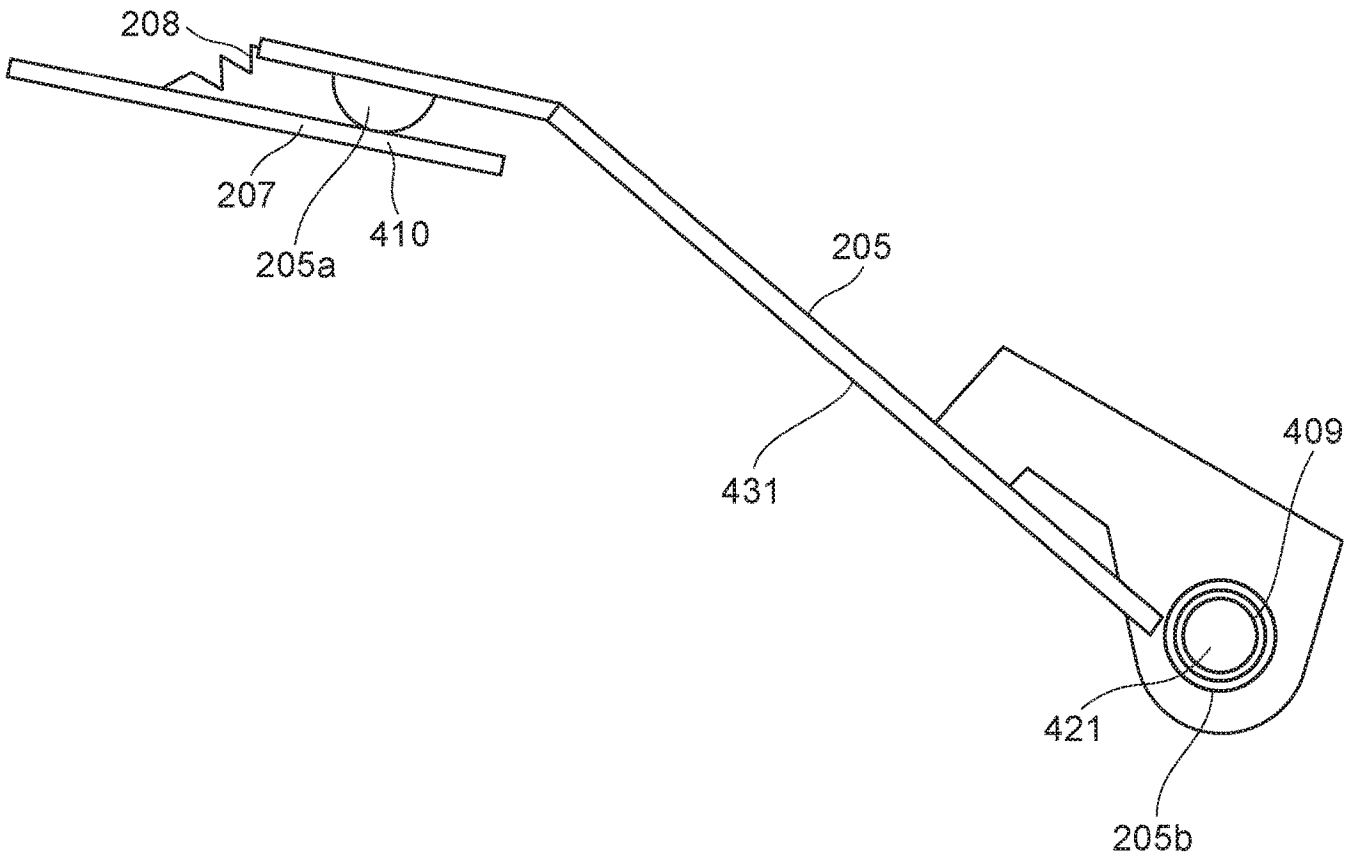
FIG. 5 is a side view of an upper guide of the first exemplary embodiment.

FIG. 5 is a schematic diagram of the upper guide 205 viewed from the side. A hole 205*b* is provided on one end of the upper guide 205. A shaft 421 of the roller 203 is inserted in the hole 205*b* of the upper guide 205. A bearing 409 is disposed between the shaft 421 and the hole 205*b*. As described above, the upper guide 205 is connected to the shaft 421 of the roller 203 through the bearing 409. In other words, the upper guide 205 is supported by the shaft 421 of the roller 203 serving as a support portion so as to be rotatable about a rotation center of the roller 203.

A spring 208 serving as a biasing unit is disposed between the upper guide 205 and the upstream guide 207. One end of the spring 208 is attached to an end portion of the upper guide 205 on a sliding portion 205*a* side. The other end of the spring 208 is attached to the upstream guide 207. The upper guide 205 is biased towards the upstream guide 207, in other words, towards the lower guide 206, with the spring 208.

An abutment portion 410 that abuts against the sliding portion 205*a* of the upper guide 205 is provided in the upstream guide 207. The sliding portion 205*a* of the upper guide 205 biased downwards with the spring 208 is abutted against the abutment portion 410 provided in the upstream guide 207. The abutment portion 410 serving as a restriction portion restricting the rotation of the upper guide 205 restricts the rotation of the upper guide 205 in a direction in which the upper guide 205 becomes closer to the lower guide 206. The sliding portion 205*a*, the hole 205*b*, and the spring 208 are each provided in each of the near side and the far side of the upper guide 205 in the thrust direction. Note that the spring constant K of the spring 208 according to the present exemplary embodiment is about 30 g/mm.

A summary of the principal portions of the configuration of the upper guide 205 described above will be given.

The upper guide 205 is rotatably supported by the shaft 421 of the roller 203. In other words, the upper guide 205 is supported so as to be rotatable about the rotation center downstream of the upper guide 205 in the sheet conveyance direction. Furthermore, the rotation of the upper guide 205 that is biased downwards with the spring 208 is restricted by the sliding portion 205*a* in contact with the abutment portion 410 of the upstream guide 207.

The operation of the upper guide 205, the configuration of which has been described above, will be described below.

Figure 6A:
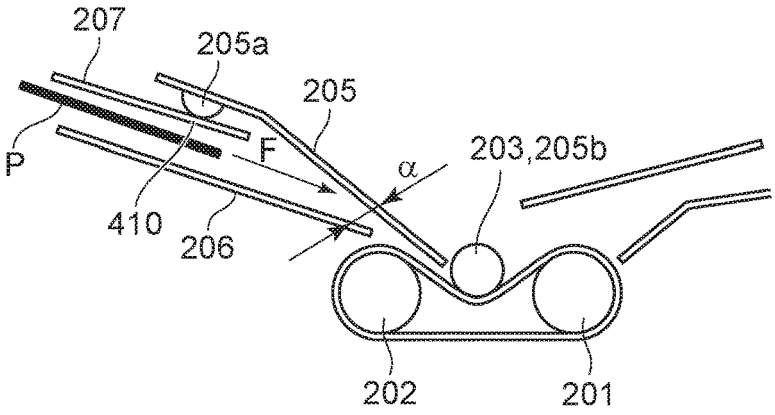
FIGS. 6A and 6B are explanatory drawings for describing an operation of the upper guide of the first exemplary embodiment.
Figure 6B:
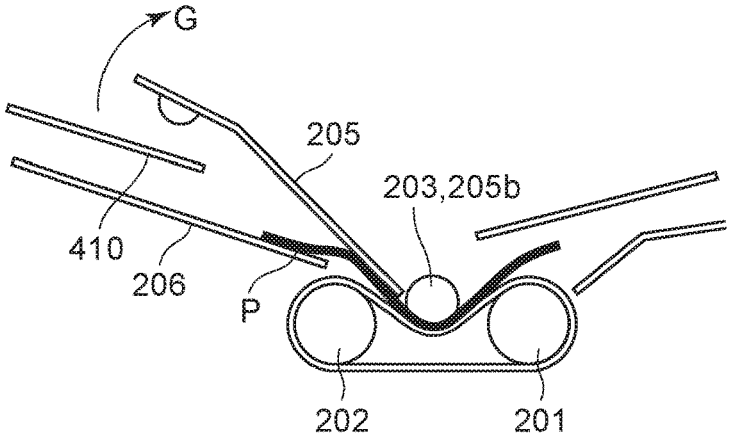

FIG. 6A illustrates the sheet P being conveyed in direction F towards the roller 203 and the belts 204 and illustrates a state in which the sheet P has not yet arrived at the roller 203 and the belts 204. FIG. 6B illustrates a state in which a thick sheet is in the midst of passing through the nip portions between the roller 203 and the belts 204.

As illustrated in FIG. 6B, the upper guide 205 rotates about the shaft 421 of the roller 203. The upper guide 205 is rotated by being pushed by the conveyed sheet countering the biasing force of the spring 208. Herein, the direction in which the upper guide 205 rotates is a direction in which the gap $\alpha$ between the upper guide 205 and the lower guide 206 becomes larger. When the upper guide 205 rotates in a direction parting from the lower guide 206, the sliding portion 205*a* of the upper guide 205 and the abutment portion 410 are separated from each other.

In other words, as illustrated in FIG. 6B, when the sheet P passes through the nip portions between the roller 203 and the belts 204, the sheet P is bent along the curve of the nip portions between the roller 203 and the belts 204. At this point, when the conveyed sheet P is a thick sheet, the upper guide 205 being pushed by the thick sheet bent by the nip portions rotates in direction G. When the upper guide 205 rotates in the direction G, the gap $\alpha$ between the upper guide 205 and the lower guide 206 becomes larger. An increase in the gap $\alpha$ upon separation of the upper guide 205 from the lower guide 206 improves the conveyance performance of the sheet P. Note that in the present exemplary embodiment, the gap between the upper guide 205 and the lower guide 206 becomes larger by 0.5 to 1.5 mm when the thick sheet is conveyed.

Advantageous effects of the configuration and the operation of the upper guide 205 described above will be described below.

When a front end of a thin sheet enters the nip portion between the upper guide 205 and the roller 203, there are cases in which a corner bend is created in the front end of the sheet. Corner bend is created more easily when the gap between the upper guide 205 and the roller 203 is larger. In the present exemplary embodiment, the upper guide 205 is disposed so that the end portion of the guide surface 431 of the upper guide 205 is close to the roller 203. Accordingly, in the present exemplary embodiment, a corner bend is prevented from being created in the front end of the thin sheet.

If, supposedly, the upper guide 205 is fixed, a shortcoming of damaging the sheet in the following manner may disadvantageously occur when conveying a thick sheet. In other words, a crease may be created in the thick sheet. The above is caused because the portion of the sheet at the nip portion between the upper guide 205 and the roller 203 is bent and the sheet upstream of the nip portion is pushed against the upper guide 205 due to the strong hardness of the thick sheet.

Furthermore, not only a crease, a scratch may be disadvantageously created in the image formed on the sheet due to the sheet being rubbed against the upper guide 205.

In the present exemplary embodiment, since the guide surface 431 of the upper guide 205 is moved up so as to be separated from the lower guide 206 using the hardness (stiffness) of the sheet, the above shortcoming can be prevented from occurring when conveying a thick sheet. In other words, since the upper guide 205 pushed by the sheet counters the biasing force of the spring 208 and is rotated, the force pushing the sheet against the upper guide 205 becomes smaller and the creation of the crease in the sheet can be reduced. Furthermore, since the force pushing the sheet against the upper guide 205 becomes smaller, creation of the scratch in the image formed on the sheet can be reduced.

Figure 14A:
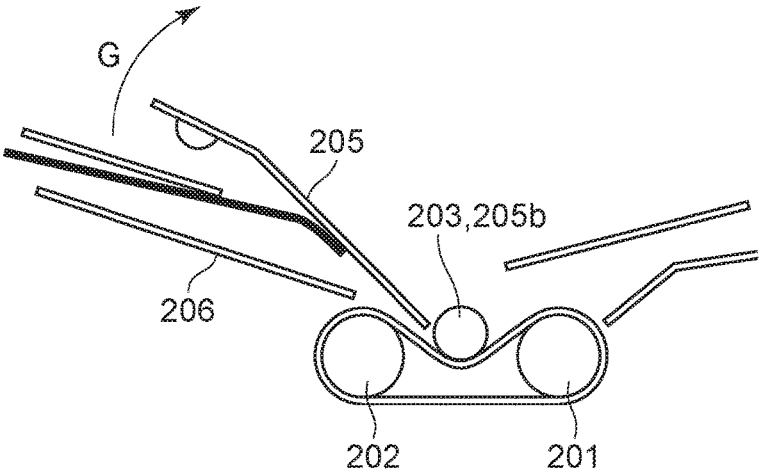
FIGS. 14A and 14B are explanatory drawings for describing an operation of the guide.
Figure 14B:
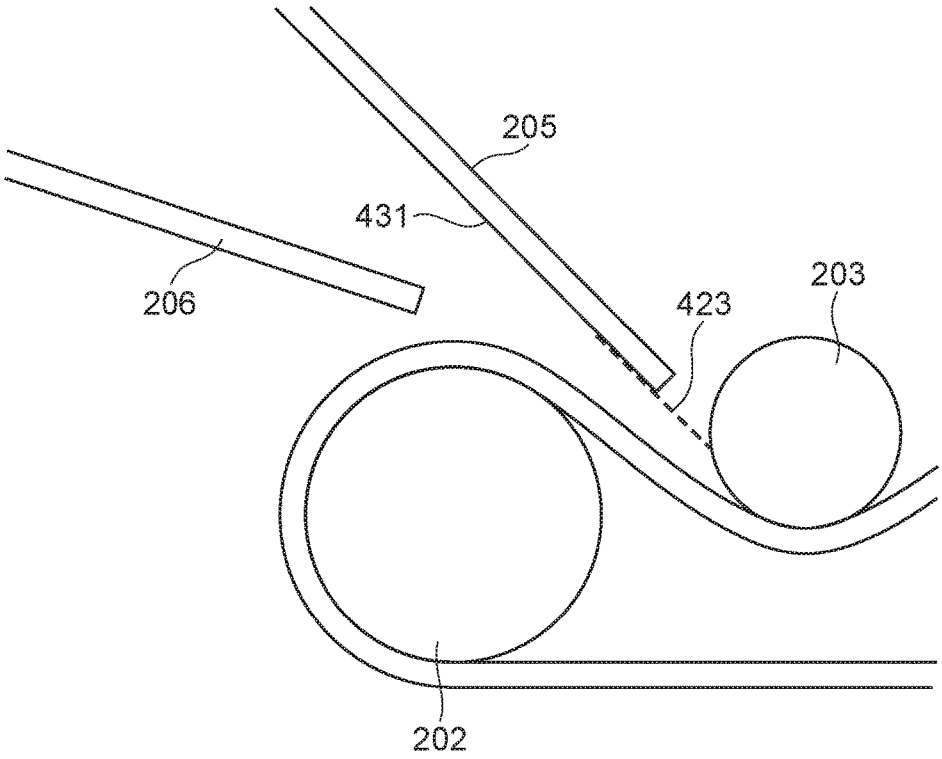

Since the upper guide 205 rotates in the direction separating the upper guide 205 from the lower guide 206 while a portion of the upper guide 205 downstream of the guide surface 431 of the upper guide 205 serves as a fulcrum, the advantageous effect described below with FIGS. 14A and 14B is obtained. FIGS. 14A and 14B illustrate a state in which the upper guide 205 is rotated by being pushed by the sheet that has not reached the nip portions between the roller 203 and the belts 204, and FIG. 14B is an enlarged view of FIG. 14A.

There are cases in which the upper guide 205 disadvantageously rotates by being pushed by the sheet before the front end of the sheet reaches the nip portions between the roller 203 and the belts 204. In such cases, there is a concern of the front end of the sheet being unable to enter the nip portions between the roller 203 and the belts 204 in a smooth manner because of the change in the position of the upper guide 205 from the position in which the upper guide 205 is abutted against the abutment portion 410. For example, there is a concern of a corner bend being created in the sheet due to the front end of the sheet entering the gap between the upper guide 205 and the roller 203.

However, in the present exemplary embodiment, the rotation center of the upper guide 205 is set at a position that coincides with the position of the rotation center of the roller 203, in other words, the rotation center of the upper guide 205 is set at a position downstream of the guide surface 431 of the upper guide 205. Accordingly, even when the upper guide 205 pushed by the sheet is rotated, an extended line 423 (see FIG. 14B) of the guide surface 431 of the upper guide 205 extends towards the nip portions between the roller 203 and the belts 204. Accordingly, the front end of the sheet enters the nip portions in a smooth manner without any corner bend.

Figure 7:
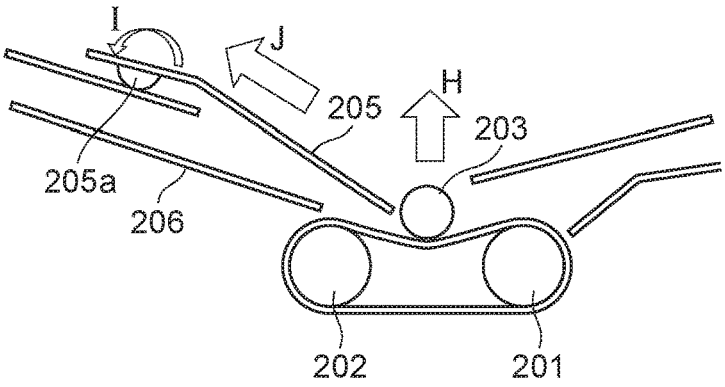
FIG. 7 is an explanatory drawing for describing an operation of the upper guide and the roller of the first exemplary embodiment.

A movement of the upper guide 205 when changing the inroad amount of the roller 203 into the belts 204 with the adjustment unit 434 will be described next with reference to FIGS. 5 and 7.

As illustrated in FIG. 5, the upper guide 205 is supported by the roller 203. The upper guide 205 follows the up and down movement of the roller 203. FIG. 7 illustrates a behavior of the upper guide 205 when the roller 203 moves up. When the roller 203 moves in direction H in the drawing, the upper guide 205 rotating about the sliding portion 205*a* in direction I slides in direction J.

In the present exemplary embodiment, the support portion that rotatably supports the upper guide 205 is the shaft 421 of the roller 203. The advantageous effect of the present exemplary embodiment in which, as described above, the support portion that rotatably supports the guide 205 moves together with the roller 203 in the sheet thickness direction will be described.

In other words, since the fulcrum of the upper guide 205 is the shaft 421 of the roller 203, even when the inroad amount of the roller 203 into the belts 204 is changed, the distance between the roller 203 and the front end of the guide surface 431 of the upper guide 205 is maintained at a uniform distance. If, supposedly, the upper guide 205 does not move and only the roller 203 moves up and down to adjust the inroad amount, disadvantageously, the sheet may abut against the roller 203 and corner bend may be created in the sheet.

As described above, in the present exemplary embodiment, the roller 203 and the upper guide 205 move in an integrated manner. Accordingly, regardless of the position of the roller 203, since he upper guide 205 is capable of stably and smoothly guiding the front end of the sheet to the nips between the roller 203 and the belts 204, less corner bends are created in the sheet.

Note that the numerical values exemplified in the exemplary embodiment described above do not limit the scope of the claim in any way.

Second Exemplary Embodiment

In a configuration of a second exemplary embodiment the position of the rotation center of the upper guide 205 is different from that in the first exemplary embodiment. Description of components that are similar to the first exemplary embodiment will be omitted.

Figure 8:
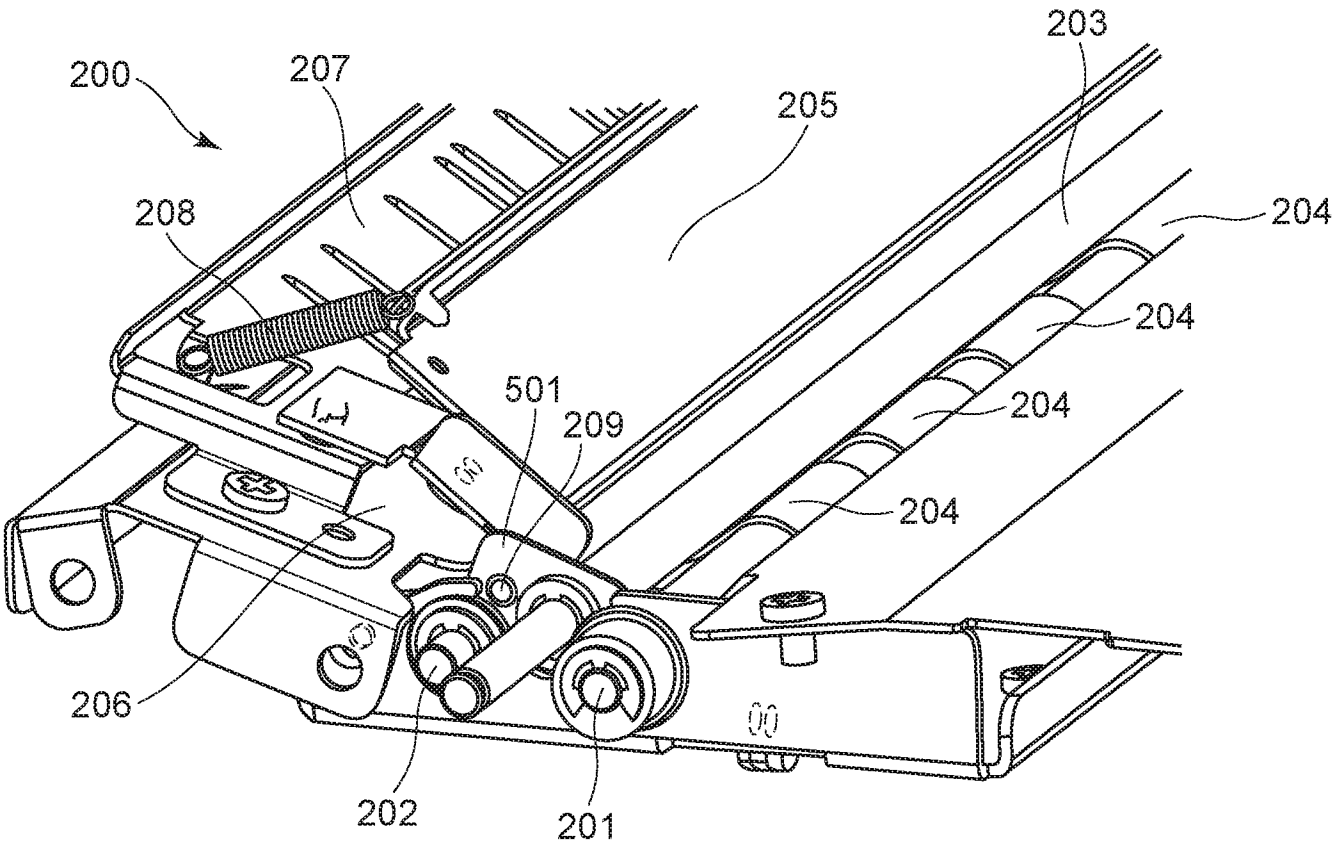
FIG. 8 is a perspective view of a decurler of a second exemplary embodiment.
Figure 9A:
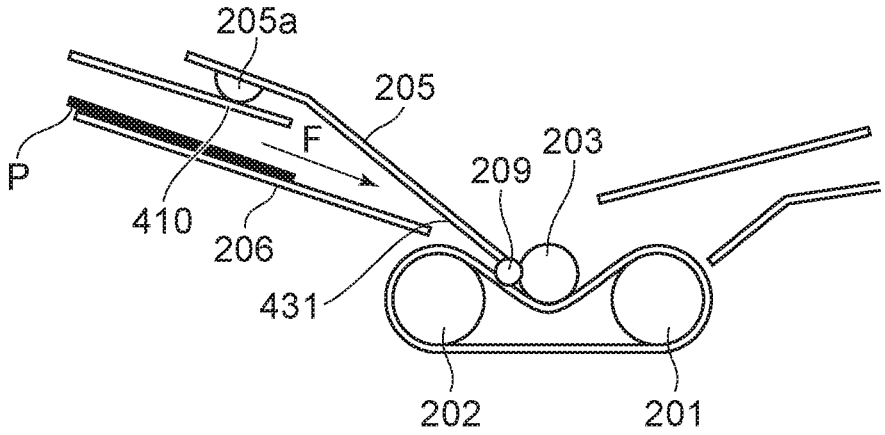
FIGS. 9A and 9B are explanatory drawings for describing an operation of a guide of the second exemplary embodiment.
Figure 9B:
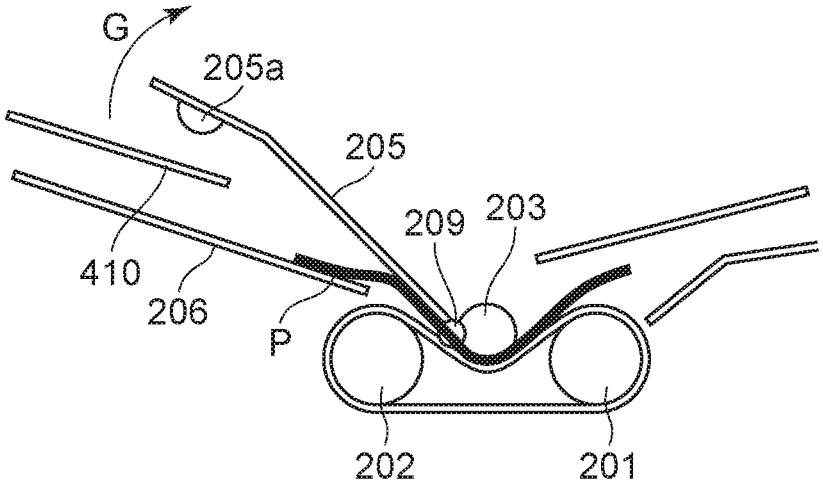

A perspective view of a decurler of the second exemplary embodiment is illustrated in FIG. 8 and side views of the decurler of the second exemplary embodiment are illustrated in FIGS. 9A and 9B. In the second exemplary embodiment, the rotation center of the upper guide 205 is set at a position that does not coincide with the position of the rotation center of the roller 203.

A support hole into which a rotating shaft 209 provided in the upper guide 205 is fitted is provided in a support member (support portion) 501 that engages with the shaft of the roller 203. The support member 501 serving as a support portion that rotatably supports the upper guide 205 is engaged with the roller 203 so as to move up and down together with the roller 203 in an integrated manner. The rotating shaft 209 of the upper guide 205 is disposed so that the axis of the rotating shaft 209 of the upper guide 205 is the front end portion (the end portion on the downstream side in the conveyance direction) of the guide surface 431 of the upper guide 205.

Compared with the first exemplary embodiment, the support member 501 for rotatably supporting the upper guide 205 is added in the second exemplary embodiment; accordingly, the configuration becomes complex. However, it will be possible to rotate the upper guide 205 about the front end of the upper guide 205, in other words, it will be possible to rotate the upper guide 205 about a position that is close to the upstream end portion of the nip portion between the upper guide 205 and the roller 203. Accordingly, regardless of the position of the guide 205 in the rotation direction, the advantageous effect of smoothly guiding the front end of the sheet to the nip portion between the upper guide 205 and the roller 203 is larger than that of the first exemplary embodiment.

Third Exemplary Embodiment

A third exemplary embodiment is different from the first exemplary embodiment in that the third exemplary embodiment includes a drive unit (a solenoid) for rotating the upper guide 205. Description of components that are similar to the first exemplary embodiment will be omitted.

Figure 10:
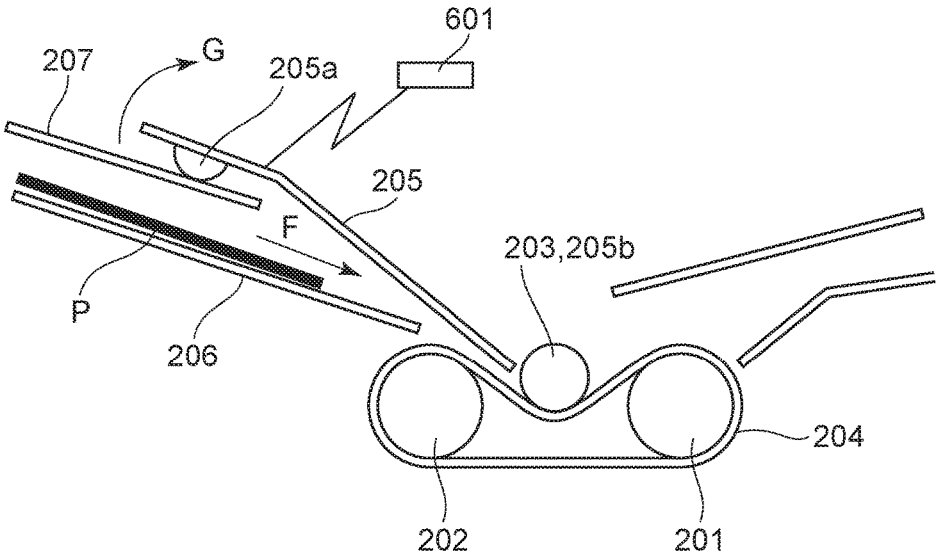
FIG. 10 is an explanatory drawing for describing an operation of a guide of a third exemplary embodiment.

FIG. 10 illustrates a schematic diagram of the third exemplary embodiment. In the third exemplary embodiment, the upper guide 205 is rotated in direction G using a solenoid 601 serving as actuator. When a thick sheet is passed through the decurler, the control unit 406 controls the solenoid 601 and rotates the upper guide 205 in direction G.

The timing in which the control unit 406 controls the solenoid 601 and starts to rotate the upper guide 205 is set immediately before the front end of the sheet enters the nip of the roller 203. By starting the rotation of the upper guide 205 immediately before the front end of the sheet enters the nip of the roller 203, damage to the thick sheet can be prevented from occurring when the front end of the thick sheet passes through the nip of the roller 203. Furthermore, at the timing after the rear end of the sheet passes through the nip portions between the roller 203 and the belts 204, the control unit 406 controls the solenoid 601 and returns the upper guide 205 to the original position where the sheet abuts against the abutment portion 410. Note that in case of a thin sheet, the operation of operating the solenoid 601 and rotating the upper guide 205 is not executed.

Note that herein, while an exemplification of a mode in which the rotation center of the upper guide 205 is the roller 203 is given, as illustrated in the second exemplary embodiment, the upper guide 205 may be rotatably supported by a support member that moves with the roller 203 in an integrated manner.

The configuration of the third exemplary embodiment is, when compared with the configuration of the first exemplary embodiment, complex. However, since the stiffness (the hardness) of the sheet does not have to be relied upon to generate the force increasing the gap between the upper guide 205 and the lower guide 206, compared with the first exemplary embodiment, the advantageous effect of preventing damage from occurring in the thick sheet is larger.

In the first to third exemplary embodiments, the spring 208 has been exemplified as the biasing unit that biases the upper guide 205 so that the upper guide 205 abuts against the abutment portion 410. However, the upper guide 205 may be biased so that the upper guide 205 abuts against the abutment portion 410 using the weight of the upper guide 205.

In the exemplary embodiments described above, an electrophotographic type image forming unit has been exemplified. However, the present disclosure may be applied to an image forming unit that forms an image on a sheet using ink jetting.

Figure 11:
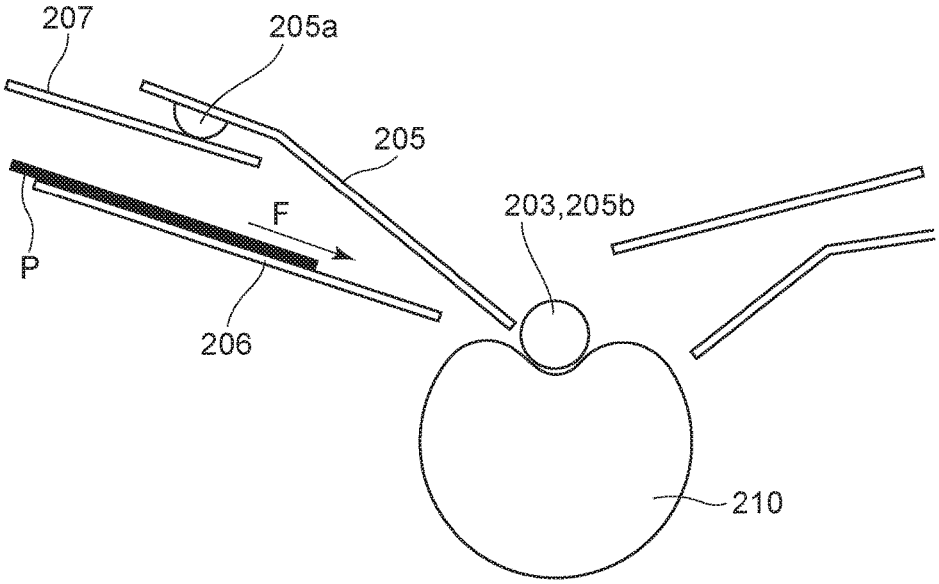
FIG. 11 is a cross-sectional view illustrating a configuration of a modification of the decurler.

In the first to third exemplary embodiments, an exemplification of a mode in which the curved nip portions are formed between the roller 203 and belts 204 has been given. However, as in the modification illustrated in FIG. 11, the device may use, in place of the belts 204, an elastic roller 210 (a sponge roller, for example) that is softer than the roller 203.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-140582, filed Jul. 14, 2015, which is hereby incorporated by reference herein in its entirety.

What is claimed is:

1. A curl correction device comprising:

a correction unit configured to correct a curl in a sheet while conveying and pinching the sheet with a curved nip portion and including a first rotation member and a second rotation member that is deformed by pressure contact with the first rotation member to form the curved nip portion;

a guide portion including a first guide disposed on a side in which a surface of the sheet comes in contact with the first rotation member and a second guide disposed opposing the first guide on a side in which a surface of the sheet comes in contact with the second rotation member, wherein, when a sheet is being conveyed, the first guide and the second guide contact the conveyed sheet to guide the sheet to the curved nip portion; and a support portion that rotatably supports the first guide about a rotation center, wherein, in a case where a sheet, having a thickness that is greater than a predetermined thickness, is pinched in the curved nip portion and caused to curve, the first guide contacts the sheet upstream of the curved nip portion and is caused by push contact with the conveyed sheet to rotate about the rotation center so that the first guide moves away from the second guide.

2. The curl correction device according to claim 1, further comprising a biasing unit that applies a biasing force to the first guide in a direction in which the first guide becomes closer to the second guide, wherein, in a case where the first guide is pushed by the conveyed sheet having the thickness that is greater than the predetermined thickness, the first guide counters the biasing force of the biasing unit and rotates about the rotation center.

3. The curl correction device according to claim 1, further comprising a moving unit that moves the first rotation member to change an inroad amount by which the first rotation member advances into the second rotation member to deform the second rotation member, wherein the support portion is moved together with the first rotation member in an integrated manner by the moving unit.

4. A curl correction device comprising:

a correction unit configured to correct a curl in a sheet while conveying and pinching the sheet with a curved nip portion and including a first rotation member and a second rotation member that is deformed by pressure contact with the first rotation member to form the curved nip portion;

a guide portion including a first guide disposed on a side in which a surface of the sheet comes in contact with the first rotation member and a second guide disposed opposing the first guide on a side in which a surface of the sheet comes in contact with the second rotation member, wherein, when a sheet is being conveyed, the first guide and the second guide contact the conveyed sheet to guide the sheet to the curved nip portion;

a moving unit that moves the first rotation member; and a support portion that rotatably supports the first guide about a rotation center so that the first guide rotates via the moving unit in an integrated manner with the first rotation member, wherein, in a case where a sheet, having a thickness that is greater than a predetermined thickness, is pinched in the curved nip portion and caused to curve, the first guide contacts the sheet upstream of the curved nip portion and is caused by push contact with the conveyed sheet to rotate about the rotation center so that the first guide moves away from the second guide.

5. The curl correction device according to claim 1, wherein the support portion that rotatably supports first guide is a shaft of the first rotation member.

6. The curl correction device according to claim 4, wherein the support portion that rotatably supports first guide is a shaft of the first rotation member.

7. The curl correction device according to claim 3, wherein the support portion is provided in a support member engaged with the first rotation member to move together with the first rotation member in an integrated manner.

8. The curl correction device according to claim 4, wherein the support portion is provided in a support member engaged with the first rotation member to move together with the first rotation member in an integrated manner.

9. The curl correction device according to claim 1,
wherein the first rotation member is a roller, and
wherein the second rotation member is a belt that forms a nip portion by being in pressure contact with the roller and is stretched across a plurality of belts.

10. The curl correction device according to claim 4,
wherein the first rotation member is a roller, and
wherein the second rotation member is a belt that forms a nip portion by being in pressure contact with the roller and is stretched across a plurality of belts.

11. The curl correction device according to claim 1,
wherein the first rotation member is a first roller, and
wherein the second rotation member is a second roller that is deformed by the first roller being in press contact therewith and is softer than the first roller.

12. The curl correction device according to claim 4,
wherein the first rotation member is a first roller, and
wherein the second rotation member is a second roller that is deformed by the first roller being in press contact therewith and is softer than the first roller.

13. The curl correction device according to claim 1, further comprising an actuator configured to rotate the first guide about the rotation center away from the second guide.

14. The curl correction device according to claim 4, further comprising an actuator configured to rotate the first guide about the rotation center away from the second guide.

15. An image forming apparatus comprising:
a correction unit configured to correct a curl in a sheet while conveying and pinching the sheet with a curved nip portion and including a first rotation member and a second rotation member that is deformed by pressure contact with the first rotation member to form the curved nip portion;
an image forming unit that forms an image on a sheet on which curl correction is performed with the correction unit;
a guide portion including a first guide disposed on a side in which a surface of the sheet comes in contact with the first rotation member and a second guide disposed opposing the first guide on a side in which a surface of the sheet comes in contact with the second rotation member, wherein, when a sheet is being conveyed, the first guide and the second guide contact the conveyed sheet to guide the sheet to the curved nip portion; and
a support portion that rotatably supports the first guide about a rotation center,
wherein, in a case where a sheet, having a thickness that is greater than a predetermined thickness, is pinched in the curved nip portion and caused to curve, the first guide contacts the sheet upstream of the curved nip portion and is caused by push contact with the conveyed sheet to rotate about the rotation center so that the first guide moves away from the second guide.

16. The curl correction device according to claim 1, wherein the correction unit is configured to receive a sheet in a duplex conveyance path that is a conveyance path through which the sheet is conveyed after switchback reversal.

17. The curl correction device according to claim 1, further comprising a restriction portion that restricts, by being in contact with the first guide, a rotation of the first guide about the rotation center in a direction in which the first guide becomes closer to the second guide,
wherein, in a case where the sheet is pinched in the curved nip portion and then contacts the first guide, the first guide rotates about the rotation center to become separated from the restriction portion while continuing to guide the sheet to the curved nip portion.

18. The curl correction device according to claim 1, further comprising a restriction portion that restricts, by being in contact with the first guide, a rotation of the first guide about the rotation center in a direction in which the first guide becomes closer to the second guide,
wherein, in a case where a sheet, having a sheet characteristic that matches a predetermined sheet characteristics, is pinched in the curved nip portion, and then contacts the first guide, the first guide remains stationary about the rotation center to remain in contact with the restriction portion while continuing to guide the sheet to the curved nip portion.

19. The curl correction device according to claim 1, wherein the first guide is caused by push contact with the conveyed sheet to rotate about the rotation center away from the second guide only while the sheet is conveyed against the first guide.

20. The curl correction device according to claim 1, wherein, in a case where a sheet, having a thickness that is equal or smaller than the predetermined thickness, is pinched in the curved nip portion and caused to curve, the first guide is prevented from rotating about the rotation center away from the second guide.

* * * * *